United States Patent [19]

Koenig

[11] Patent Number: 5,052,468

[45] Date of Patent: Oct. 1, 1991

[54] METHOD AND APPARATUS FOR DIE CASTING SHOT CONTROL

[75] Inventor: Manfred M. Koenig, Kenosha, Wis.

[73] Assignee: Diecasting Machinery & Rebuilding Co., Waukegan, Ill.

[21] Appl. No.: 409,937

[22] Filed: Sep. 20, 1989

[51] Int. Cl.[5] ..... B22D 46/00; B22D 17/04; B29F 1/04

[52] U.S. Cl. ..... 164/457; 164/113; 164/315; 425/146; 425/149; 264/40.1

[58] Field of Search ..... 164/312, 314, 315, 154, 164/113, 457; 425/145, 146, 149; 264/40.1

[56] References Cited

U.S. PATENT DOCUMENTS

| | | | |
|---|---|---|---|
| 2,634,468 | 4/1953 | Holder | 164/315 |
| 2,671,247 | 3/1954 | Lester | 164/155 |
| 3,601,180 | 8/1971 | Nef | 164/315 |
| 3,693,702 | 9/1972 | Piekenbrink | 164/314 |
| 3,861,457 | 1/1975 | Bl Py | 164/155 |
| 3,891,126 | 6/1975 | Segawa | 164/314 |
| 3,893,792 | 7/1975 | Laczyko | 164/155 |
| 4,011,902 | 3/1977 | Koch | 164/314 |
| 4,019,561 | 4/1977 | Aoki | 164/314 |
| 4,022,269 | 5/1977 | Segawa | 164/314 |
| 4,066,189 | 1/1978 | Toyoaki et al. | 222/334 |
| 4,208,879 | 6/1980 | Segawa | 164/314 |
| 4,256,644 | 3/1981 | Farrell | 425/159 |
| 4,282,176 | 8/1981 | Farrell | 264/40.1 |
| 4,330,026 | 5/1982 | Fink | 164/457 |
| 4,354,545 | 10/1982 | Goldhammer | 164/457 |
| 4,488,589 | 12/1984 | Moore et al. | 164/155 |
| 4,559,991 | 12/1985 | Motomura | 164/155 |
| 4,660,602 | 4/1987 | Ozeki | 164/457 |
| 4,844,146 | 7/1989 | Kikuchi | 164/312 |

FOREIGN PATENT DOCUMENTS

| | | | |
|---|---|---|---|
| 478397 | 11/1951 | Canada | 164/315 |
| 2021539 | 4/1971 | Fed. Rep. of Germany | 164/315 |

*Primary Examiner*—Richard K. Seidel
*Assistant Examiner*—Rex E. Pelto
*Attorney, Agent, or Firm*—Welsh & Katz, Ltd.

[57] ABSTRACT

A method and apparatus for injecting molten material such as molten metal into a die cavity under pressure from a shot cylinder wherein a valve arrangement is provided which prevents undesirable pressure spikes in the die cavity during injection of molten material, and which effects rapid pressure buildup in the die cavity during solidification and curing of the molten material. The valve arrangement is operative to effect a regenerative or counterforce mode in the shot cylinder which limits the force applied during injection of molten material into the die cavity so as to substantially reduce pressure spikes, the regenerative mode being terminated in response to a predetermined pressure within the die cavity indicating that the die cavity is full.

10 Claims, 1 Drawing Sheet

METHOD AND APPARATUS FOR DIE CASTING SHOT CONTROL

BACKGROUND OF THE INVENTION

The present invention relates generally to injection molding, and more particularly to a novel method and apparatus for controlling the injection of molten material such as molten metal into a die cavity under pressure from a shot cylinder so as to eliminate undesirable pressure spikes while effecting high pressure during curing of the molten material.

It is well recognized in the art of injection molding, such as in die casting machines or apparatus which employ shot cylinders to inject "shots" of molten material into a die cavity, that controlling the speed of the shot cylinder piston during injection of molten material into the die cavity is critical to preventing pressure spikes or peak pressures which may exceed the die clamping force capacity of the machine and cause separation of the die halves. The pressure spikes may result from both excessive fluid pressure applied to the shot cylinder and the inertia forces created by the shot cylinder piston and associated piston and plunger rods. Separation of the die halves can lead to casting fins being formed on the casting and tolerance ranges being exceeded, thereby leading to unacceptable castings with attendant waste and economic loss.

U.S. Pat. No. 4,066,189 discloses apparatus for controlling injection of molten material under pressure into a die cavity, and attempts to overcome the problem of peak pressure within the die cavity by decreasing the speed of the shot cylinder piston before the mold cavity is completely filled. A relatively complex fluid pressure system provides a run-around circuit between the rod end of the shot cylinder and the head end thereof, and includes means for blocking the flow path through the run-around circuit in response to advance of the shot cylinder piston, whereafter advance of the shot piston is controlled by controlling release of fluid pressure from the rod end of the shot cylinder.

U.S. Pat. No. 4,488,589 discloses a shot cylinder controller for controlling the speed of a shot cylinder so as to compensate for changes in operating variables resulting from changes in the fluid mechanics of the system. The shot cylinder controller employs a relatively complex servo-control system which includes a preselected computer program to control the shot cylinder.

A significant drawback with the known prior apparatus for controlling shot cylinders in die casting machines lies in their reliance on relatively complex arrangements to control the shot cylinder so as to eliminate or substantially reduce pressure spikes during injection of molten material into the die cavity, while effecting rapid pressure buildup within the die cavity during solidification and curing of the molten material.

SUMMARY OF THE INVENTION

One of the primary objects of the present invention is to provide a novel method and apparatus for controlling the injection of molten material into a die cavity so as to prevent undesirable spike or peak pressures in the die cavity while effecting high pressure during curing of the molten material.

A more particular object of the present invention is to provide a method and apparatus for controlling the injection of molten material into a die cavity which employs a novel valve arrangement interposed between a fluid pressure source and a shot cylinder and operative to place the shot cylinder in a regenerative mode so as to prevent pressure spikes within the die cavity during injection of molten material, and which effects rapid high pressure buildup in the die cavity during curing of the molten material.

A further object of the present invention is to provide a method and apparatus for controlling the injection of molten material into a die cavity from a shot cylinder as aforedescribed wherein the valve arrangement is operative to terminate the regenerative mode when the die cavity is filled with molten material, and substantially simultaneously effect rapid pressure buildup within the die cavity during curing of the molten material.

In carrying out the present invention, a valve arrangement is interposed between a fluid pressure source and the shot cylinder of an injection molding machine so as to enable selective fluid pressure input to the head end of the shot cylinder to inject molten material into the die cavity. The valve arrangement includes a first proportional throttle valve enabling predetermined introduction of fluid pressure to the head end of the shot cylinder, a second valve operative to create a regenerative mode limiting the fluid pressure applied to the shot cylinder piston so as to prevent undesirable pressure spikes within the die cavity during injection of molten material, and a third valve operative in responsive to predetermined impact pressure to terminate the regenerative mode while the second valve simultaneously effects high pressure buildup within the die cavity during solidification and curing of the molten material The first, second and third valves may be formed as an integral valve unit, or as valves modules manifolded to provide a compact shot control device.

Further objects, features and advantages of the present invention, together with the organization and manner of operation thereof, will become apparent from the following detailed description of the invention when taken in conjunction with the accompanying drawings wherein like reference numerals designate like elements throughout the several views.

DETAILED DESCRIPTION

Figure 1:
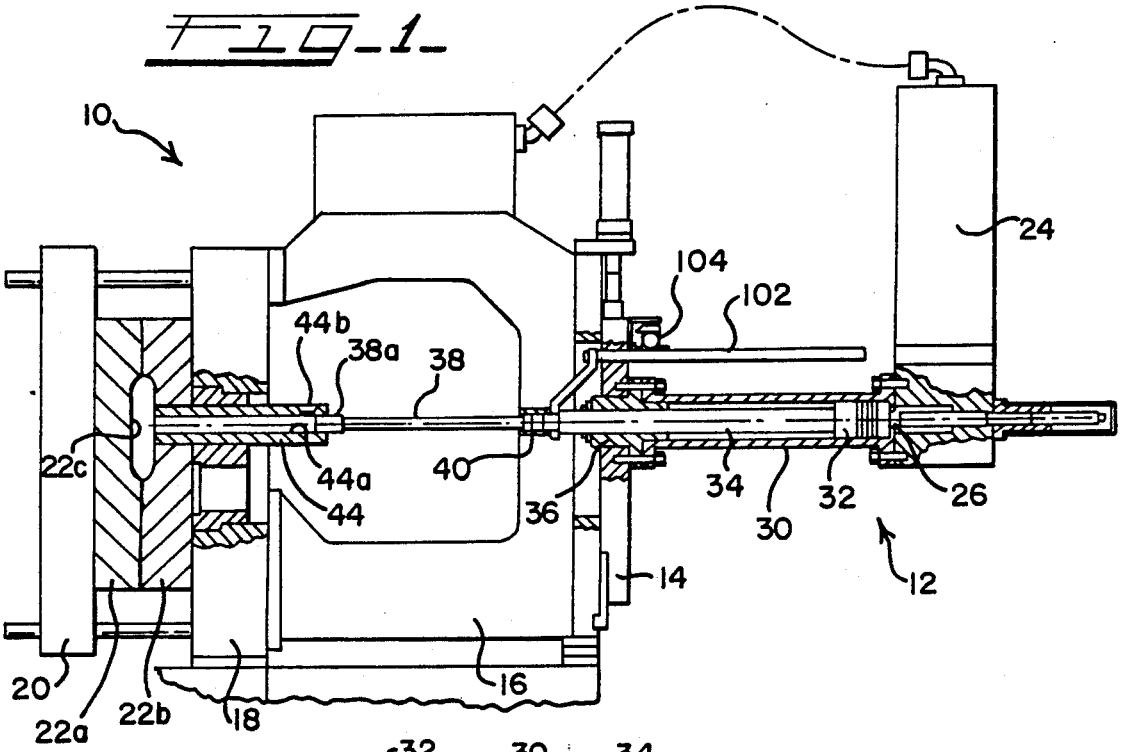
FIG. 1 is a fragmentary elevational view of a die casting machine having a shot cylinder assembly of the type with which the present invention is employed.

Referring now to the drawing, and in particular to FIG. 1, the present invention is illustrated, by way of example, in conjunction with a conventional shot type die casting machine, a fragmentary portion of which is illustrated generally at 10. The illustrated portion of the die casting machine is representative of a typical shot end of a cold chamber die casting machine in which a shot cylinder is cooperative with a cold chamber to inject molten material into a die cavity.

The shot end of the die casting machine includes a shot cylinder assembly, indicated generally at 12, which is mounted on a support plate 14 affixed transversely to a generally C-shaped frame 16. Frame 16 is secured to a vertical stationary platen 18 of the die casting machine The platen 18 cooperates with a movable platen 20 to support conventional die halves 22*a,b* which in closed positions define a die cavity 22*c* adapted to receive injected molten material, such as molten aluminum, plastic or other material which lends itself to shot type injection molding. The die halves 22*a,b* define a parting plane therebetween and are held in closed positions by the platens 18 and 20 which are conventionally operated by hydraulic cylinders so as to apply a predetermined clamping force to the die halves and enable opening for removal of a formed casting. A fluid pressure reservoir or accumulator 24 is affixed to the rear or head end of the shot cylinder assembly 12 and defines a fluid pressure inlet 26 to the head end of the shot cylinder assembly.

The shot cylinder assembly 12 may be of conventional design and includes a shot cylinder 30 having a piston 32 and associated piston rod 34 longitudinally slidable within the cylinder such that the piston rod extends through a suitable bushing and seal assembly 36 at the rod end of the shot cylinder. The forward or outer end of the piston rod is connected to a plunger rod 38 through a plunger rod coupler 40. The forward end of the plunger rod has a cylindrical plunger tip 38*a* which is received within a cylindrical bore 44*a* formed axially through a cold chamber 44 supported by and extending through the stationary platen 18 such that the bore 44*a* is axially aligned with the plunger rod 38. The cold chamber 44 has a radial inlet port 44*b* to facilitate entry of molten material into the cold chamber when the plunger tip 38*a* is withdrawn to the rearward end of the chamber preparatory to an injection cycle. The forward end of the cold chamber bore 44*a* communicates with the die cavity 22*c* such that forward extension of the piston rod 34 and associated plunger rod 38 causes molten material to be injected from the cold chamber into the die cavity by the plunger tip 38*a*. Such injection is effected by introducing fluid pressure to the head end of the shot cylinder through the inlet port 26.

As aforementioned, when a quantity or "shot" of molten material is injected into a die cavity under pressure by a shot cylinder in a die casting machine, the pressure within the die cavity may undergo a sudden substantial increase or pressure spike as the molten material fills the die cavity and the plunger tip impacts against the confined molten material. If the fluid pressure applied to the head end of the shot cylinder is sufficiently high, the velocity and inertia energy of the shot piston and associated piston rod may result in a pressure spike or peak pressure within the die cavity which exceeds the clamping force capacity of the machine and causes the die halves to separate, with the result that flashing fins may be formed on the casting, dimensional tolerance ranges may be exceeded, and/or poor density achieved in the casting, thereby resulting in an unacceptable casting which requires corrective treatment or which may not be salvageable.

Figure 2:
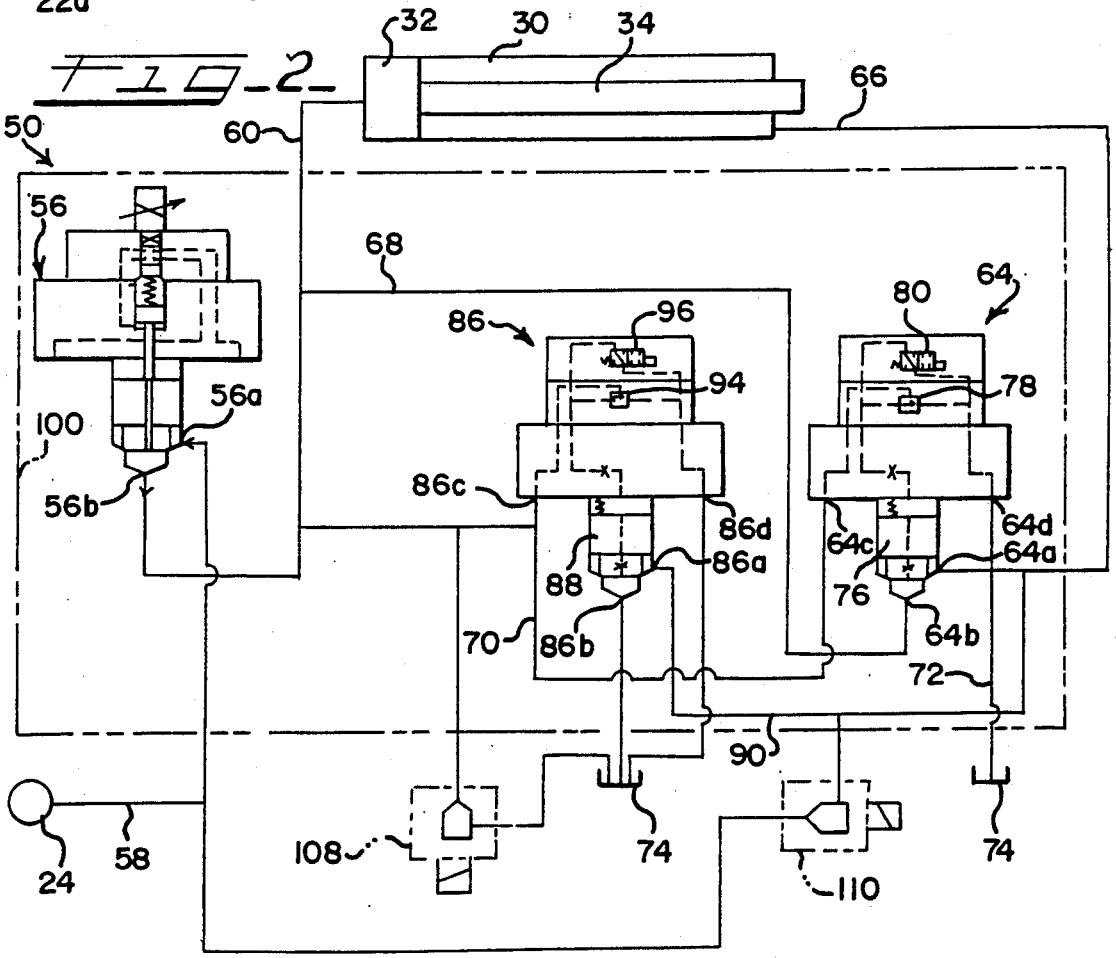
FIG. 2 is schematic diagram illustrating a valve control arrangement in accordance with the present invention for controlling the shot cylinder of a die casting machine.

Referring to FIG. 2, the present invention provides a control valve arrangement, indicated generally at 50, which is operative to control the shot cylinder assembly 12 so that the pressure applied to the shot cylinder during injection of molten material into the die cavity is sufficiently low to prevent harmful pressure spikes, but which effects high pressure application to the molten material within the die cavity during solidification and curing. To this end, the valve arrangement 50 is operative to effect a regenerative or counterforce mode for the shot cylinder which prevents full pressure application against the shot piston during injection of molten material into the die cavity, and is operative to terminate the regenerative mode and establish high pressure in the die cavity during solidification and curing of the molten material.

The valve arrangement 50 is interposed between a fluid pressure source, such as the aforementioned fluid pressure reservoir or accumulator 24 and an associated fluid pressure pump, and the shot cylinder 30. In the illustrated embodiment, the shot cylinder 30 comprises a double acting hydraulic cylinder or ram. The valve arrangement 50 includes a first control valve, indicated generally at 56, in the form of a proportional throttle valve having an inlet port 56*a* connected through a fluid pressure line or conduit 58 to the fluid pressure source 24, and having an outlet port 56*b* connected through a fluid pressure line or conduit 60 to the head end of the shot cylinder 30. As will be described, valve 56 is adapted to be programmed to provide predetermined flow of fluid pressure from the pressure source to the head end of the shot cylinder during each injection stroke of the shot cylinder piston 32 to inject molten material from the cold chamber into the die cavity. Control valve 56 is of conventional design, such as commercially available from Rexroth Corporation as its Model FE 63C, or from Towler Corporation as its Model TDA D 1097 E63LA.

The valve arrangement 50 includes a second control valve, indicated generally at 64, which is interconnected between the rod end of the shot cylinder and the head end thereof. The control valve 64 has an inlet port 64*a* connected to the rod end of the shot cylinder through a fluid pressure line or conduit 66, and has an outlet port 64*b* connected to the head end of the shot cylinder through a fluid pressure line or conduit 68. The control valve 64 comprises a normally open vented cartridge valve such as commercially available from Towler Corporation as its bypass valve with electrical unloading, Model DAV B 6 E63, and has a pressure sensing port 64*c* connected to the head end of the shot cylinder 30 through a fluid pressure sensing line or conduit 70. Valve 64 also has a tank port 64*d* connected through a flow line or conduit 72 to a fluid tank or reservoir indicated schematically at 74. A poppet 76 within valve 64 is biased to a closed position normally preventing communication between the ports 64*a* and 64*b*, and has its upper end ported to the tank port 64*d* through parallel flow paths, one of which includes a normally open adjustable-setting pressure responsive valve, such as a poppet valve indicated schematically at 78, and the other of which includes a normally closed solenoid actuated spool valve indicated schematically at 80. The setting of valve 78 is such that it will close in response to a predetermined pressure sensed at the sensor port 64*c* which, as aforedescribed, senses the pressure at the head end of the shot cylinder 30 and thereby, indirectly, the pressure in the die cavity 22*c*. The solenoid actuated spool 80 serves as a bypass control valve which is normally closed but which enables selective opening to connect the head end of poppet 76 to tank 74 by energizing the solenoid. Thus, the rod end of the shot cylinder 30 is normally in fluid communication with the head end thereof to establish a regenerative or counterforce mode through the flow conduits 66 and 68 and control valve 64. Closing poppet 76 terminates such communication and thereby the regenerative or shot piston counterforce mode.

The valve arrangement 50 includes a third control valve, indicated generally at 86, which is generally similar to control valve 64 but is normally closed between an inlet port 86*a* and a discharge port 86*b* by a poppet 88. The inlet port 86*a* is connected to the rod end of the shot cylinder 30 through a fluid pressure line or conduit 90, while the discharge port 86*b* is connected to the tank or fluid reservoir 74. Valve 86 includes a pressure sensing port 86*c* which is connected through the fluid pressure line 70 to the head end of the shot cylinder 30, and has a tank or vent port 86*d* connected through a flow conduit 92 to the tank or fluid reservoir 74. The poppet 88 is biased to a normally closed position but has its head end adapted for porting to the tank port 86*d* through parallel flow paths, one of which is controlled by a normally closed adjustable-setting pressure responsive valve, such as a poppet valve 94, and the other of which is controlled by a normally closed solenoid actuated spool valve 96. The normally closed valves 94 and 96 prevent unintentional opening of the poppet 88 by pressure at the inlet port 86*a*.

The valves 56, 64 and 86 may be termed valve functions and are preferably formed or built into a single unitary compact manifold the periphery of which is schematically indicated by phantom line 100, or may be of individual modular design and interconnected through a manifold block. For example, the valves may be formed as valve blocks mounted on a common manifold which is suitably bored to provide the aforedescribed fluid pressure lines between the various ports of the valves, and which has external ports enabling connection of the various valve functions through hydraulic lines to the head and rod ends of the shot cylinder 30, the fluid pressure source 24 and the tank or fluid accumulator 74. In this manner, the valve arrangement 50 may provide a compact valve control device for controlling the shot cylinder of a die casting machine, and may be utilized in original manufacture or in retrofitting existing die casting machines.

In the operation of the valve arrangement 50 to control the shot cylinder 30 during injection of molten material into the die cavity 22*c* from the cold chamber 44, and assuming the shot cylinder piston to be in its fully retracted position, that molten material has been introduced into the cold chamber 44*a*, and that valve 64 is in an open condition and valve 86 is in a closed condition, fluid pressure to the head end of the shot cylinder is controlled by control valve 56. As aforedescribed, control valve 56 is programmable and is programmed to initially fully open to apply full fluid pressure flow to the head end of the shot cylinder. With valve 64 in an open condition, the rod end of the shot cylinder is in fluid pressure communication with the head end of the shot cylinder through the fluid pressure conduits 66 and 68 so as to establish a regenerative or counterforce circuit between the rod and head ends of the shot cylinder. By establishing a regenerative or counterforce mode during injection of molten material into the die cavity, the force applied to the head end of the piston is limited to a magnitude equal to the fluid inlet pressure times the effective transverse cross sectional area of the piston rod 34. Stated alternatively, by connecting the rod end of the shot cylinder to the head end, a counterforce acts on the rod end of the shot piston of a magnitude equal to the pressure at the rod end acting on the annular area of the piston about the piston rod, thus significantly reducing the force acting to move the shot piston in a forward material injection direction. This significantly reduces or limits the longitudinal acceleration imparted to the shot piston, and thereby reduces or limits the inertia forces acting on the plunger tip 38*a* during injection of molten material into the die cavity 22*c*. In this manner the impact pressure applied by the plunger tip against the molten material as the die cavity becomes full is maintained sufficiently low to prevent pressure spikes which might exceed the clamping capacity of the die casting machine and cause the die halves 22*a,b* to open.

To further prevent undesirable pressure spikes within the die cavity during injection of molten material, valve 56 may be programmed to close a predetermined amount at a predetermined time after the shot piston commences its forward movement, such as when the plunger tip 38*a* is approximately 2–3 inches from full impact, to further reduce the impact force and prevent a pressure spike or peak sufficient to overcome the clamping capacity of the die casting machine. To this end, a piston position indicating rod 102 (FIG. 1) is carried by the piston rod in parallel relation therewith, and is cooperative with a conventional distance measuring device, indicated schematically at 104, to generate a signal indicating the linear distance traversed by the plunger tip 38. Such position signal is transmitted to the control for the programmable control valve 56 to effect diminished fluid pressure flow to the head end of the shot cylinder at a predetermined time in the injection cycle.

After impact of the plunger tip 38*a* against the molten material within the filled die cavity, the valve arrangement 50 operates to increase the pressure within the die cavity during solidification and curing of the molten material. The valves 64 and 86 sense the pressure within the head end of the shot cylinder through their respective sensor ports 64*c* and 86*c*. The internal poppet valve 94 in valve 86 is set to open when a predetermined pressure is detected at the head end of the shot cylinder, such predetermined pressure being a function of the impact pressure, such as 1000 psi, exerted by the plunger tip 38*a* against the molten material which indicates full impact of the plunger tip. Opening of poppet valve 94 vents the top of poppet 88 to tank causing poppet 88 to open and connect the rod end of the shot cylinder to tank 74. This terminates the regenerative mode.

The internal poppet valve 78 in control valve 64 is set to close at substantially the same pressure sensed at the head end of the shot cylinder which causes the control valve 86 to open, thereby preventing fluid pressure flow from the head end of the shot cylinder to the tail end thereof. This assures full termination of the regenerative mode so that the fluid pressure at source 24 acts on the full area of the head end of the shot cylinder piston 32. Simultaneously, the programmed control valve 56 is caused to again fully open to enable full fluid pressure flow to the head end of the shot cylinder. Thus, at a predetermined point in the injection cycle corresponding to impact of the plunger tip 38*a* within the filled die cavity, full pressure is applied to the head end of the shot cylinder to obtain rapid pressure buildup within the die cavity during solidification and curing of the molten material within the die cavity.

As aforementioned, the control valves 64 and 86 also include solenoid operated spool valves 80 and 96, respectively, which enable selective manual closing of valve 64 and opening of valve 86 so as to effect a full forward fluid pressure force to the head end of the shot cylinder. Alternatively, automatic closing and opening of valves 64 and 86 may be effected by an electronic timing control (not shown) which times out the application of full pressure within the die cavity during curing, whereafter a signal is applied to the solenoid valves to close valve 64 and open valve 86 to enable return of the shot piston to its retracted position preparatory to the next injection cycle. To facilitate return of the shot piston, a pair of solenoid operated valves, indicated schematically at 108 and 110 in FIG. 2, are connected in fluid pressure communication with the shot cylinder and the pressure source 24 and tank 74 so that upon energizing the solenoid valves 108 and 110, the head end of the shot cylinder is connected to tank through valve 108, while the fluid pressure source 24 is connected to the rod end of the shot cylinder through valve 110 to effect retraction or return of the shot piston.

In accordance with the valve arrangement 50 of the present invention, the fluid pressure acting on the head end of the shot cylinder piston is controlled so that any pressure spike or peak pressure buildup within the die cavity as the plunger tip impacts the filled cavity is greatly diminished, such as in the order of 3:1, by the use of the aforedescribed regenerative or counterforce circuit. For example, the initial pressure applied by the plunger tip 38*a* to the molten material as it is injected from the cold chamber may be approximately 200 psi. By effecting the regenerative mode, as the die cavity fills with molten material the impact pressure of the molten material within the die cavity may increase to approximately 1000 psi without creating a dangerous pressure spike. At this moment, the valve arrangement 50 terminates the regenerative mode enabling full pressure to be applied against the head end of the shot cylinder piston to thereby achieve high pressure within the die cavity during solidification and curing of the molten material.

As aforedescribed, the valve arrangement 50 may be formed as a unitary manifolded compact valve device or as a plurality of modular valve units manifolded to a single manifold. Either embodiment facilitates use in the initial manufacture of die casting machines or in retrofitting existing die casting machines. The regenerative mode established by the valve arrangement 50 is maintained until impact occurs independent of the time lapse between initial movement of the shot piston and impact. Thus, the valve arrangement 50 automatically compensates for varying operating characteristics resulting from changes in the fluid mechanics of the system by being responsive to a predetermined impact pressure, as opposed to employing a shot piston position responsive servo system as heretofore employed.

While a preferred embodiment of the present invention has been illustrated and described, it will be understood that changes and modifications may be made therein without departing from the invention in its broader aspects. Various features of the invention are defined in the following claims.

What is claimed is:

1. In a die casting machine including a shot cylinder having an internal piston defining a head end and a rod end, a chamber adapted to receive molten material, means defining a die cavity, and a source of fluid pressure, said shot cylinder being cooperative with said chamber to enable injection of molten material into said die cavity from said chamber upon application of fluid pressure to the head of said shot cylinder; the improvement comprising fluid pressure control means interconnected between the shot cylinder and said fluid pressure source, said control means including a valve arrangement having a first control valve interposed between the fluid pressure source and the head end of the shot cylinder and operative to control fluid pressure flow to said head end so as to establish a predetermined maximum pressure within the die cavity during a die casting cycle, a second valve interconnected between the rod end of said shot cylinder and said head end thereof, said second valve being normally conditioned to effect fluid pressure communication between said rod and head ends of said shot cylinder and establish a regenerative mode limiting the net pressure force acting on the head end of said piston to a value wherein the pressure within said die cavity at impact is less than said predetermined maximum pressure, and a third valve operatively associated with said head and rod ends of said shot cylinder and having direct fluid pressure communication with said head end of said piston, said third valve being directly responsive to a predetermined pressure at said head end to reduce the pressure at said rod end to substantially atmospheric pressure, said second valve being responsive to said predetermined pressure at said head end to block fluid pressure communication between said head and rod ends and thereby enable said maximum pressure within said die cavity during solidification and curing of molten material within said die cavity.

2. A die casting machine as defined in claim 1 wherein said first valve comprises a programmable control valve operative to reduce the fluid pressure flow to the head end of said shot cylinder at a predetermined time prior to impact of molten material within said die cavity.

3. A die casting machine as defined in claim 2 wherein said second valve comprises a normally open valve responsive to a predetermined pressure at the head end of the shot cylinder to interrupt fluid pressure communication between the head and rod ends of said shot cylinder.

4. A die casting machine as defined in claim 3 wherein said third valve comprises a normally closed valve responsive to said predetermined pressure at the head end of said shot cylinder to connect said rod end to tank at substantially atmospheric pressure.

5. A die casting machine as defined in claim 4 wherein said first, second and third valves are formed within a compact manifold block having external ports enabling connection to said pressure source, said head and rod ends of said shot cylinder, and to a tank at substantially atmospheric pressure.

6. A die casting machine as defined in claim 5 wherein said second and third valves include solenoid valve means enabling selective conditioning of said first and second valves to effect said maximum pressure within said die cavity.

7. A method for controlling the injection of molten material into a die cavity from a shot cylinder during a die casting cycle, said cylinder including a piston having a head end and an associated rod end cooperative with a shot chamber to inject molten material into the die cavity from the shot chamber in response to fluid pressure applied to the head end of the piston, said method comprising the steps of:

(a) determining the fluid pressure required to be applied to the head end of said piston to effect a maximum desired pressure in the die cavity during solidification and curing of molten material when injected into said die cavity, (b) selectively connecting the head end of said piston to a source of fluid pressure through a first valve operative to apply sufficient fluid pressure to said head end to effect said maximum pressure in the die cavity, (c) selectively interconnecting the rod end of said shot cylinder in fluid pressure communication with the head end thereof through a second normally open valve operative to create a fluid pressure counterforce limiting the net pressure force applied to said head end during injection of molten material into the die cavity so as to establish a pressure within the die cavity less than said maximum desired pressure, (d) reducing the pressure at said rod end to substantially atmospheric pressure through a third normally closed valve which is directly responsive to the pressure at said head end and opened to effect said pressure reduction when the pressure at said head end reaches a predetermined value less than the fluid pressure determined in step (a), and (e) terminating fluid pressure communication between said rod and head ends by closing said second valve substantially simultaneously with reducing the pressure at said rod end to atmospheric pressure so as to effect said maximum desired pressure within the die cavity during solidification and curing of molten material injected therein.

8. The method as defined in claim 7 wherein said step of selectively interconnecting said rod and head ends of said shot cylinder in fluid pressure communication includes interconnecting said rod and head ends through discrete fluid pressure flow paths one of which includes said normally open valve and the other of which includes said normally closed valve, said normally closed valve being responsive to a predetermined pressure at said head end to open and connect said rod end to substantially atmospheric pressure, and said normally open control valve being responsive to said predetermined pressure at said head end to close and block fluid pressure communication between said head and rod ends and thereby terminate said fluid pressure counterforce whereby to enable said maximum desired pressure within said die cavity.

9. The method as defined in claim 8 wherein said normally open and normally closed valves include means enabling manual control to effect said maximum desired pressure within said die cavity.

10. The method as defined in claim 7 including the step of controlling fluid pressure flow to the head end of said cylinder through a programmable valve operative to restrict fluid pressure flow to said head end just prior to impact of molten material within said die cavity, said programmable valve being conditioned to enable full fluid pressure flow to said head end immediately after impact of molten material within said die cavity.

* * * * *

UNITED STATES PATENT AND TRADEMARK OFFICE

CERTIFICATE OF CORRECTION

PATENT NO. : 5,052,468

DATED : October 1, 1991

INVENTOR(S) : Manfred M. Koenig

It is certified that error appears in the above-identified patent and that said Letters Patent is hereby corrected as shown below:

Column 2, line 32, insert a period (.) after the word "material".

Column 7, line 65, insert --end-- after the word "head".

Signed and Sealed this

Nineteenth Day of January, 1993

*Attest:*

*Attesting Officer*

DOUGLAS B. COMER

*Acting Commissioner of Patents and Trademarks*